US008745866B2

(12) United States Patent
Blakeman et al.

(10) Patent No.: US 8,745,866 B2
(45) Date of Patent: Jun. 10, 2014

(54) VALVE LIFTER GUIDE AND METHOD OF FORMING SAME

(75) Inventors: Rex Blakeman, Michigan Center, MI (US); Jim McLean, Grass Lake, MI (US)

(73) Assignee: APQ Development, LLC

( * ) Notice: Subject to any disclaimer, the term of this patent is extended or adjusted under 35 U.S.C. 154(b) by 111 days.

(21) Appl. No.: 13/465,865

(22) Filed: May 7, 2012

(65) Prior Publication Data

US 2012/0311834 A1 Dec. 13, 2012

Related U.S. Application Data

(63) Continuation-in-part of application No. 12/582,810, filed on Oct. 21, 2009, now Pat. No. 8,171,906.

(60) Provisional application No. 61/107,125, filed on Oct. 21, 2008.

(51) Int. Cl.
*B21K 1/76* (2006.01)

(52) U.S. Cl.
USPC ..... 29/888.03; 123/90.52; 123/90.5

(58) Field of Classification Search
USPC ..... 123/90.52, 90.48, 90.5; 29/888.03
See application file for complete search history.

(56) References Cited

U.S. PATENT DOCUMENTS 8,171,906 B2 * 5/2012 Blakeman et al. ..... 123/90.5

* cited by examiner

*Primary Examiner* — Zelalem Eshete
(74) *Attorney, Agent, or Firm* — Honigman Miller Schwartz and Cohn LLP

(57) ABSTRACT

A method of molding a valve lifter guide includes determining a flow path of injected material in the mold cavity by including a thin walled section in the formed guide. A leading edge of the material flow path forms a dam when crossing a thin walled section in the mold cavity to change a direction of a portion of the leading edge of the material flow path, until the leading edge meets a trailing edge of the material. The valve lifter guide includes a front wall, rear wall, a first radiused end wall, a second radiused end wall, and a bottom surface having an elongated socket. A tab extending from the valve guide support member has a first projection. The valve guide support member is disposed between the engine block and a cylinder head and the first projection is received in an opening of the engine block.

7 Claims, 7 Drawing Sheets

VALVE LIFTER GUIDE AND METHOD OF FORMING SAME

CROSS REFERENCE TO RELATED APPLICATIONS

The present application is related to and claims the benefit of priority from U.S. patent application Ser. No. 12/582,810 filed Oct. 21, 2009, which claims priority from U.S. Provisional Patent Application No. 61/107,125 filed Oct. 21, 2008, the entire disclosures of which are incorporated herein by reference.

BACKGROUND

The present disclosure relates generally to valve lifter guides for internal combustion engines, and more particularly to such a valve lifter guide and its method of forming.

DESCRIPTION OF THE RELATED ART

Conventionally, internal combustion engines include a cylinder block, also commonly referred to as an engine block, containing banks of cylindrical bores for receiving the engine's reciprocating pistons. Atop the engine block there are secured one or more cylinder heads. In many conventional internal combustion engines, the cylinder head defines part of the combustion chamber, and further includes mechanical components such as one or more camshafts, spark plugs, and parts of the valve train such as the valve lifters. In other conventional internal combustion engines, the camshaft or camshafts are disposed in the engine block. In such engines, the cylinder head may include fewer or even no (e.g., a "flat head" type engine) mechanical components.

Valve lifters for internal combustion engines translate cam lobe action through mechanical linkage to operate the intake and exhaust valves. Guide means are usually employed to properly maintain the orientation of the valve lifter as it reciprocates in response to rotary motion of the cam shaft. More specifically, orientation of valve lifters is usually accomplished by forming a fiat orientation surface on the valve lifter which is oriented to the axis of the valve lifter roller and cooperates with a guide engaging the lifter orientation surface to prevent rotation of the valve lifter about its axis. Usually, two parallel flat surfaces are defined upon each lifter located upon opposite sides of the lifter axis. Exemplary of conventional valve lifters and valve lifter guides in these respects are the patents of Moretz, U.S. Pat. No. 5,088,455, and Moretz et al., U.S. Pat. No. 6,257,189, the disclosures of which are incorporated herein by reference in their entireties.

Presently, valve lifter guides are secured directly to the engine block by means of bolts, such as taught in U.S. Pat. No. 5,088,455, metal springs, retainers, or other separate fastening components. The employment of such separate components slows production time and adds to the expense of engine manufacture.

One solution to the foregoing problem is found in the disclosure of Evans et al., U.S. Pat. No. 6,745,737, which teaches an internal combustion engine with an engine block and a longitudinal extending anti-rotation guide that is affixed in a receiving groove of the engine block. The guide is constructed as an injection molded component with a one-piece, molded-on, elastically expanded or deformable clip that engages in a complementary receiving contour on the engine block.

Accordingly, there is a need in the art for a valve lifter guide that has a more cost effective construction and facilitates assembly of internal combustion engines and a method of forming such a valve lifter guide.

SUMMARY

Accordingly, the present disclosure relates to a method for installing a valve lifter guide assembly in an engine block of an internal combustion engine. The method includes the steps of providing a valve lifter guide having a front wall, an opposed rear wall, and end walls therebetween the front wall and rear wall. A bottom surface is positioned at a lower edge of the front wall, rear wall and end walls, and arranged to form an elongated valve lifter socket defining a longitudinal axis. The elongated socket is dimensioned to receive a valve lifter therein. A valve guide support member extends upwardly from the rear wall and a tab projects away from the valve guide support member along an axis which is non-parallel to the longitudinal axis of the elongated valve lifter socket. The tab includes a first projection extending away from the tab and dimensioned to be received in an opening provided in the engine block of an internal combustion engine. An engine block has an opening for receiving the valve lifter guide, and the engine block further has a bore positioned proximate the opening, the bore is dimensioned to receive therein the first projection of the valve lifter guide. The method also includes the step of placing a valve lifter in the valve lifter guide. The method further includes the step of inserting the first projection of the tab into the bore in the engine block as the preassembled valve lifter guide is received in the-engine block opening so that the valve lifter guide is suspended within the engine block opening. The method further includes the step of fixing a cylinder head to the engine block so that the tab of the valve lifter guide is captured between the cylinder head and the engine block.

A method of molding a valve lifter guide is also provided. The method includes the steps of preparing a mold having a mold cavity configured to form a valve lifter guide. The method also includes the steps of determining a flow path of material to be injected in the mold cavity by including a thin walled section in the formed valve lifter guide, and selecting a gate position in the mold cavity for a gate to inject material into the mold cavity according to the determined flow path of material. The methodology further includes the steps of injecting material into the mold cavity through the gate, such that a leading edge of the material flow path forms a dam when the leading edge of the material flow path crosses a thin walled section of the mold cavity, and the dam changes a direction of a portion of the leading edge of the material flow path until the leading edge of material flow meets a trailing edge of the material flow path within the mold cavity.

An advantage of the present disclosure is that the a valve lifter guide is provided that can be fixed in the engine block without additional fasteners such as bolts, clips, or the like. Another advantage of the present disclosure is that a method of forming the valve lifter guide is provided that has a more cost effective construction. Yet another advantage of the present disclosure is that a method of installing the valve lifter guide is provided that facilitates assembly of internal combustion engines since the valve lifter is preassembled in the valve lifter guide prior to installation. A further advantage of the present disclosure is that a method of forming a valve lifter guide is provided that includes a thin walled section in the formed valve lifter guide so as to control the flow path of material during the molding process. Yet a further advantage of the present disclosure is that the valve lifter guide formed by the method described herein results in a valve lifter guide having increased strength and durability.

Other features and advantages of the present disclosure will be readily appreciated, as the same becomes better understood in view of the subsequent description taken in conjunction with the accompanying drawings.

DESCRIPTION

Figure 1:
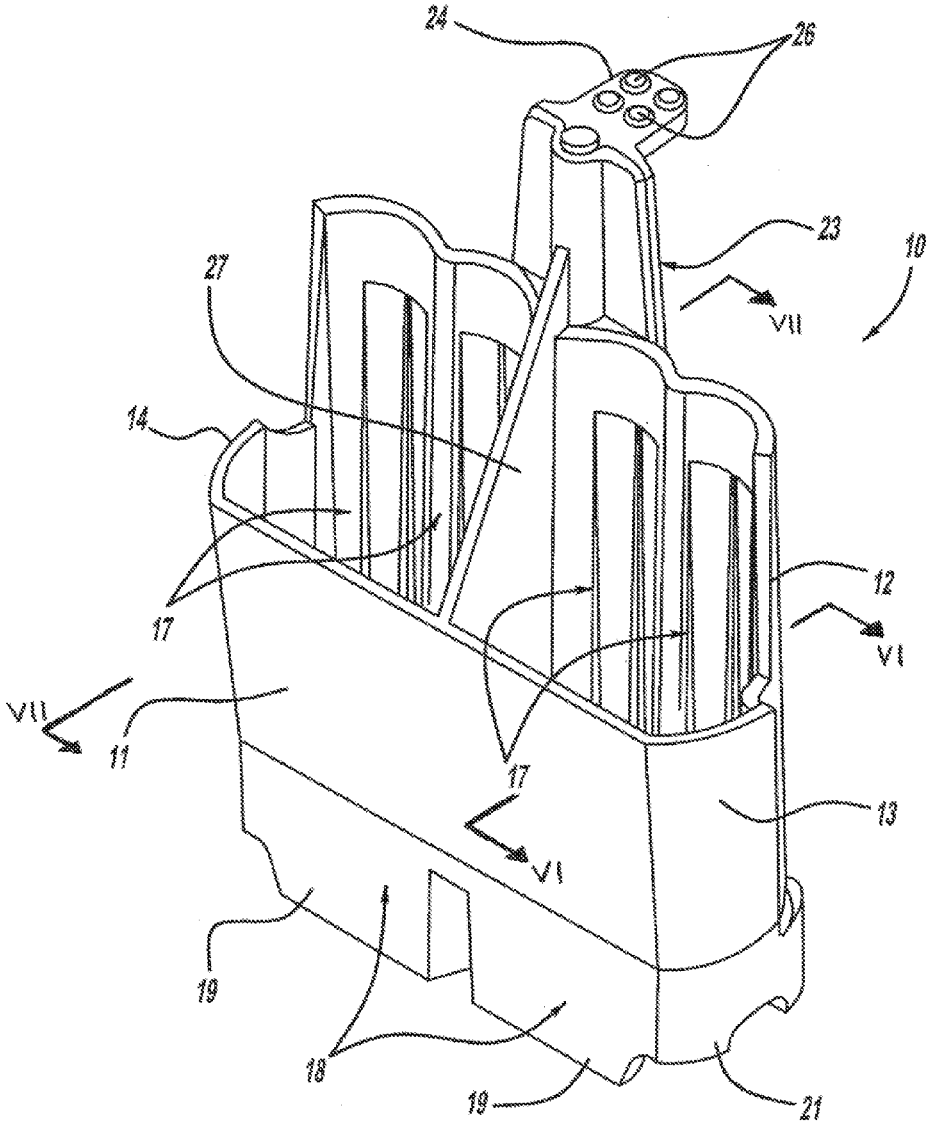
FIG. 1 is a perspective view of a valve lifter guide, according to an exemplary embodiment.

Referring to the drawings, the valve lifter guide 10 includes opposing front 11 and rear 12 walls, opposing, radiused end walls 13, 14, and a bottom surface 15 including a plurality of openings 16. Openings 16 are each dimensioned to permit passage therethrough of a single valve lifter (not shown) oriented generally coaxially with an axis extending through the center of the opening. Collectively, front 11 and rear 12 walls, end walls 13, 14, and openings 16 in bottom surface 15 define a plurality of valve lifter sockets 17 centered on each opening 16 and having a longitudinal axis coaxial with the axis extending through the center of each opening 16 and generally normal to the plane of bottom surface 15. In the illustrated example, these sockets 17 are each roughly demarked by the adjacent, semi-cylindrical sections defined by the geometry of the rear wall 12 (best seen in FIGS. 1 and 2).

Further, each socket 17 is partially defined by a pair of fingers 18, each constituting an extension of one of the front 11 or rear 12 walls below the plane of bottom surface 15. Each finger 18 is cantilever supported and includes an outer free end 19 and a flat inner surface 20 which is in spaced opposed relationship to the inner surface 20 of the opposed finger. Opposed fingers 18 may be reverse tapered for clearance purposes, as later described.

Each finger 18 includes a lateral portion that defines a web 21 at the finger edge. The webs 21 generally form a plane which is transversely related to the plane of the associated finger internal surface 20, and the webs 21 reinforce the fingers against deformation in a direction transverse to the plane of the internal surfaces 20.

As noted, conventional valve lifters are characterized by a pair of spaced parallel flat surfaces defined on the outer end of the valve lifter, these flat surfaces constituting guide surfaces which cooperate with the fingers 18 of the lifter guide. The distance separating these lifter flat surfaces is preferably slightly greater than the distance separating the finger internal surfaces 19 of a common socket 17 whereby a negative clearance originally exists and a zero clearance exists between the fingers 18 and these lifter surfaces when in engagement. The opposed fingers 18 of each socket 17 are formed with a reverse taper, i.e. the distance separating the inner surfaces 19 is less proximate the terminal edges of fingers 18 than it is further away from these terminal edges. This reverse finger taper causes the fingers to engage the lifter flat surfaces only at the terminal edges with zero clearance and a slight clearance between the fingers and lifter flat surfaces further away from these terminal edges. The resiliency or spring of the fingers 18 permits a zero clearance to accurately position the lifters without producing excessive frictional resistance to movement of the lifters between the fingers.

As previously stated, the finger webs 21 reinforce the associated fingers 18 against deformation and the dimension of the webs will be predetermined to provide the desired degree of finger resiliency or stiffness resisting deformation. Each pair of opposing fingers 18 at least partially defines a socket which receives the outer end of the valve lifter upon which its flats are defined. Preferably, the lateral edge portions of the fingers are obliquely disposed to the plane of the associated fingers internal surface forming web or wing portions whereby the wing portions stiffen and strengthen the fingers against deformation in a direction transverse to the plane of the fingers internal surfaces. By varying the width or angle of the wing portions the stiffness or flexibility of the fingers can be controlled for the particular application. In this manner, the fingers are reinforced, but are still capable of slight deformation as needed to maintain the zero clearance relationship with the associated valve lifter.

During operation, the axial displacement of the valve lifters under the influence of the camshaft cam lobe (not shown) is less than the depth of the associated socket 17 such that the fingers 18 will maintain the embraced valve lifter during all phases of its movement and maintain the proper rotational orientation of the valve lifter to its associated cam lobe.

Of course, the foregoing example including the fingers 18, webs 21, and associated structure, are not necessary to practicing the invention as claimed. Accordingly, it is contemplated that the valve lifter guide may take any of a number of alternative forms, depending upon a variety of factors known to those of skill in the art. Furthermore, it will be understood by those skilled in the art that the valve lifter guide can be formed in a number of configurations as determined by the particular engine in which the guide is to be used. For instance, as most automobile engines use two valves with each cylinder, i.e. a fuel intake valve and an exhaust valve, each cylinder will have two valve lifters associated therewith requiring a pair of guides for each cylinder. As such, the lifter guide components may be formed in two unit sets.

Figure 6:
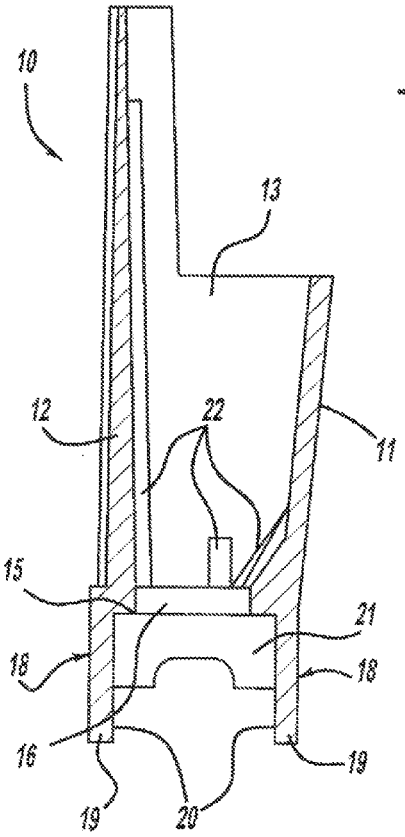
FIG. 6 is a cross-sectional view of the valve lifter guide as taken along lines 6-6 of FIG. 1.
Figure 7:
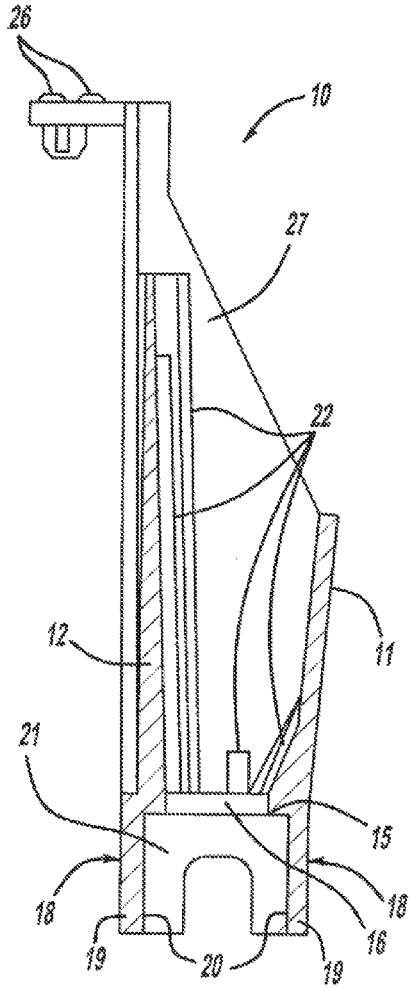
FIG. 7 is a cross-sectional view of the valve lifter guide as taken along lines 7-7 of FIG. 1.

Front 11 and rear 12 walls above the bottom surface 16 may optionally be provided with a plurality of raised guide ribs 22 (best seen in FIGS. 2, 6 and 7) extending from adjacent the openings 16 upwardly generally parallel to the longitudinal axis L. When inserting the valve lifter rods through the openings 16, the raised guide ribs 22 will tend to center a valve lifter rod (not shown) with the opening 16, thus facilitating assembly (and reducing the chance of mis-assembly) of valve lifter rods with the valve lifter.

Figure 2:
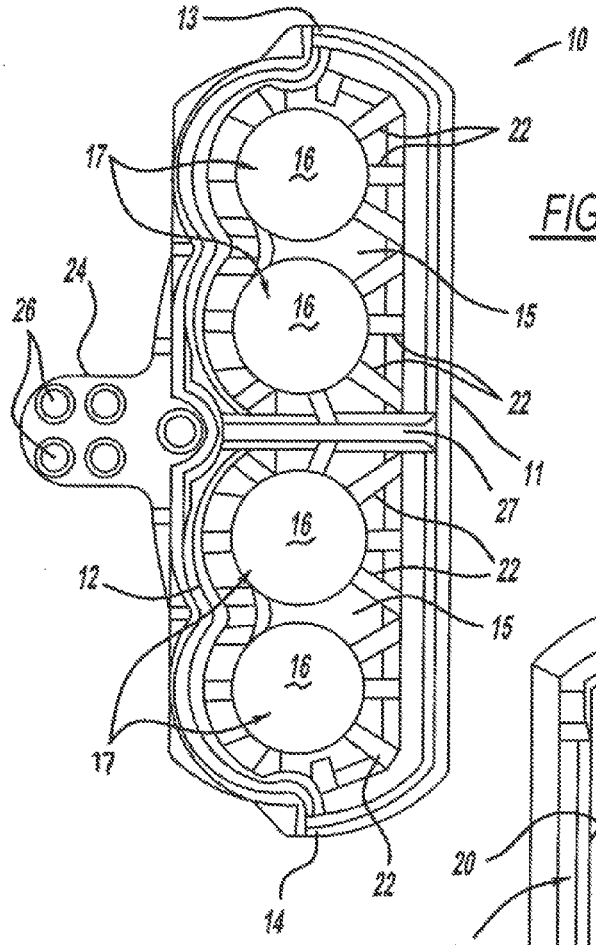
FIG. 2 is a top view of the valve lifter guide of FIG. 1.
Figure 3:
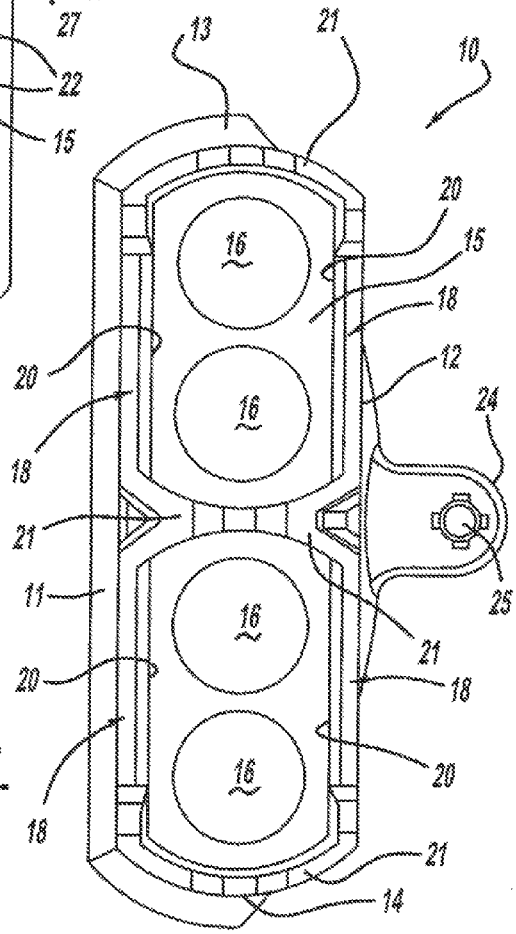
FIG. 3 is a bottom view of the valve lifter guide of FIG. 1.

As shown best in FIG. 1, rear wall 12 extends upwardly to a greater extent than front wall 11. Behind rear wall 12 and formed integrally therewith there is provided a valve guide supporting member 23 that tapers in width as it extends upwardly beyond the upper edge of rear wall 12. At its terminus, a tab 24 projects away from the valve lifter guide 10 along an axis which is non-parallel to the longitudinal axis of each socket 17. In the illustrated embodiment, this axis is approximately perpendicular to the longitudinal axis of each socket 17. A projection 25 extending downwardly from the lower surface of the tab 24*b* is dimensioned to be received in an opening provided in the engine block (E). Tab 24 defines a generally planar surface, oriented substantially perpendicular to the orientation of the projection 25, which is captured between the engine block and cylinder head (C) when the valve lifter guide 10 is installed in an engine. The upper surface of tab 24*a* can include one or more smaller projections 26 which may be deformed under compression between the engine block and cylinder head to increase the positional securement of the guide 10.

The downward extending projection 25 and the relatively smaller projections 26 can have a variety predetermined shapes, such as cylindrical, frustoconical, rectangular, or the like. The projections may also be in other forms, such as dimples, nodules, or the like. The projections can vary in size and can be arranged in a predetermined orientation, such as symmetrically, evenly spaced apart from one another, or the like. The downward projection 25 and smaller projections 26 can also include surface features such as grooves, ribs, or the like, to further facilitate secure attachment of the valve lifter guide 10 to the engine. In one example, the downward projection 25 is substantially cylindrical with four tabs 40 extending transversely and radially therefrom. In the same example, the tab 24 includes four smaller projections 26 having a frusto-conical shape that are arranged symmetrically in relation to one another and are also evenly spaced apart from one another. While one downwardly extending projection and four upwardly extending projections are shown, any number of downwardly and upwardly extending projections are contemplated that extend from any direction and surface on the valve lifter guide.

A reinforcing wall 27 transverse to the front 11 and rear 12 walls extends between and interconnects the front 11 and rear 12 walls, the bottom surface 15. Reinforcing wall 27 tapers toward the terminus of the valve guide supporting member 23. As shown best in FIG. 2, the reinforcing wall 27 effectively separates the valve lifter guide 10 into two pairs of sockets 17 for valve lifters, one pair disposed on each side of the reinforcing wall 27.

The reinforcing wall 27 can have a variety of predetermined shapes and sizes such as polygonal, rectangular, triangular, or the like. In one example, the reinforcing wall 27 has a polygonal shape having a lower portion 27*a* that is substantially rectangular and an upper portion 27*b* that tapers upward therefrom to define a substantially triangular shape, such that the reinforcing wall 27 tapers from an upper edge of the front wall 11*a* to a middle portion of the valve guide supporting member 23*a*. The reinforcing wall 27 can have a predetermined thickness to provide sufficient strength and rigidity to the valve lifter guide. In one example, the reinforcing wall 27 has a thickness that is substantially the same thickness as the front wall 11 and rear wall 12. The valve lifter guide 10 can be formed as one integral unitary body, multiple pieces, a combination thereof, or the like. For example, the reinforcing wall 27 can be formed integrally with the front wall 11 and the rear wall 12.

The valve lifter guide may be manufactured, for instance by injection molding, from a synthetic plastic polyamide such as Nylon 66. This material may be reinforced with a glass-fiber filler, and may further comprise a molybdenum disulfide additive to increase the lubricity even beyond that which is inherently present in the nylon material. Such a material is commercially obtainable under the name NYLATRON GS-51 (DSM Engineering Plastics, Inc., Evansville, Ind.). The lubricity achieved by the use of the nylon reinforced material of the valve lifter guides ensures close and accurate guiding of the valve lifters even under zero clearance interfaces, and by impregnating the material with molybdenum disulfide lubricity is further enhanced. Further, by the utilization of the synthetic polymeric material superior wear characteristics are achieved between the guide and valve lifter, weight is reduced. However, it is contemplated that the valve lifter guide could also be manufactured of other materials, including, by way of example only, other polymers, ceramics, or metals.

Figure 8:
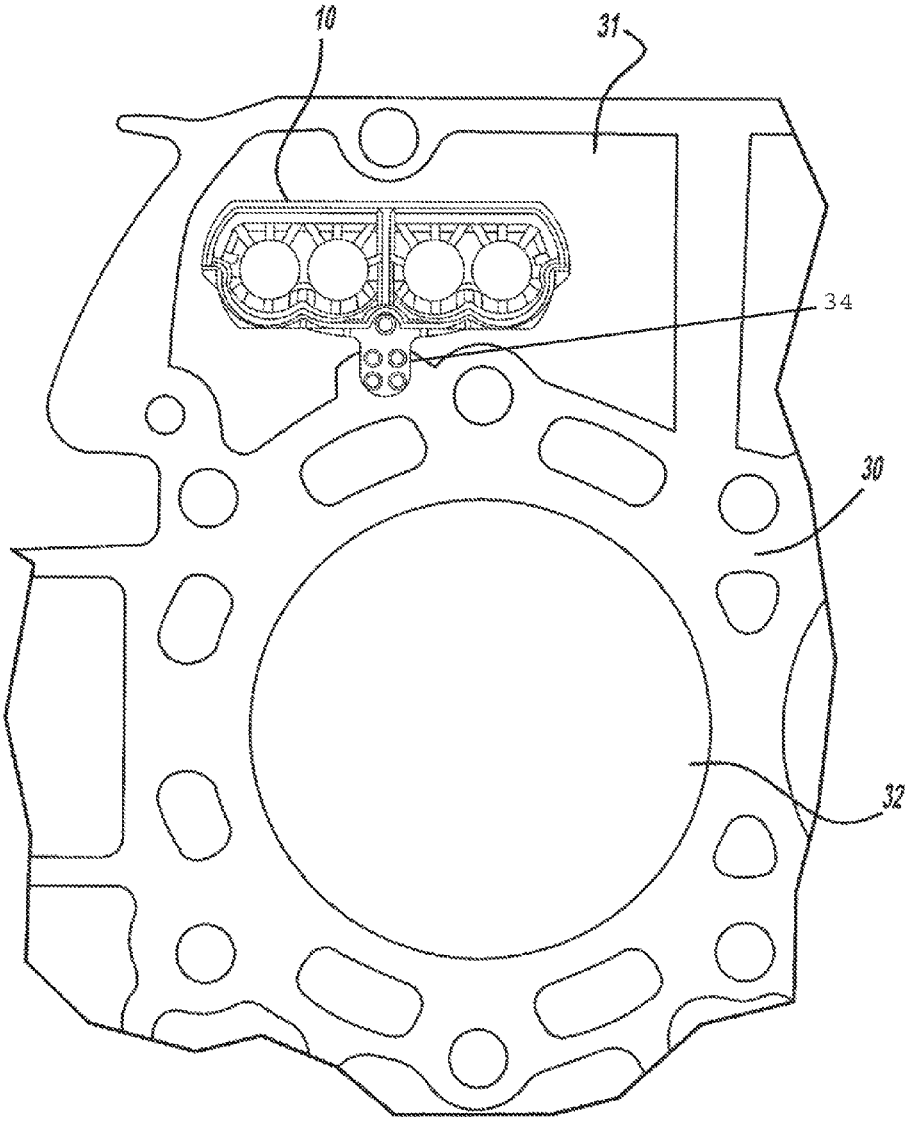
FIG. 8 is a top-down view of an exemplary valve lifter guide in position on the engine block of an internal combustion engine.

Referring now to FIG. 8, the valve lifter guide 10 is mounted upon an internal combustion engine block 30 as shown. Specifically, the engine block 30 is provided with an opening 31 proximate each piston bore 32 in which the valve lifter guide 10 is inserted. Proximate this opening 31 there is provided in the engine block 30 a blind bore, as shown at 34. A valve lifter is positioned within the valve lifter guide 10, and the interference fit between the lifters and guides allows the operator to put the lifters in the guide without falling out. Projection 25 is slidingly received in the bore 34 as the valve lifter guide 10 with valve lifter already in place, is lowered into the opening 31 so that valve lifter guide 10 is suspended within the opening 31.

As each of the one or more cylinder heads (not depicted) is fixed in place on the engine block 30, the tab 24 which rests upon the surface of the engine block is captured between the bottom surface of the cylinder head and the upper surface of the engine block 30, thereby fixing the position of the valve lifter guide 10. The projections 26 are deformed to increase the positional securement of the guide 10 within the engine block 30.

Figure 9:
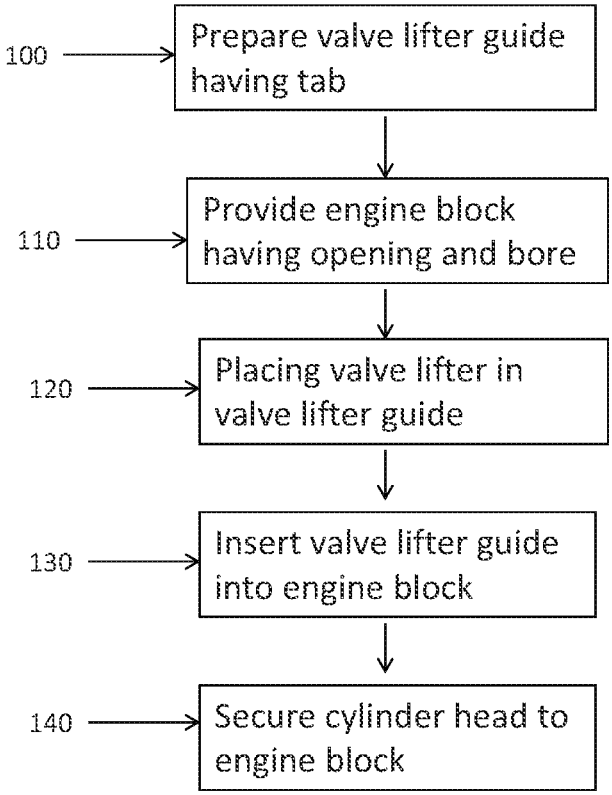
FIG. 9 is a flowchart illustrating a method of installing the valve lifter guide of FIG. 1 in an engine block of an internal combustion engine.

Referring now to FIG. 9, a flowchart illustrating a method of installing a valve lifter guide in an engine block of an internal combustion engine is shown. The method begins at block 100 and includes the step of providing a valve lifter guide 10 having a tab 24 with a projection 25, as previously described. The method then proceeds to block 110 and includes the step of providing an engine block 30 having an opening 31 for receiving the valve lifter guide 10 and a bore 34 for receiving the projection 25 therein. Next, the method proceeds to block 120 and includes the step of preassembling the valve lifter into the valve lifer guide 10. The methodology advances to block 130 and includes the step of inserting the valve lifter guide in the opening 31 in the engine block while the projection 25 of the valve lifter guide 10 is slidingly received into the bore 34 in the engine block 30. The valve lifter guide 10 is thus suspended within the opening 31 in the engine block 30. The method then proceeds to block 140 and includes the step of securing a cylinder head to the engine block 30 so that the tab 24 of the valve lifter guide 10 is captured between the cylinder head and the engine block 30. The projections 26 formed on the upper surface of the tab 24 are crushed, so as to fix the position of the valve lifter guide between the cylinder head and engine block. As a result of this interference fit, the need for an additional fastener is eliminated.

Figure 10:
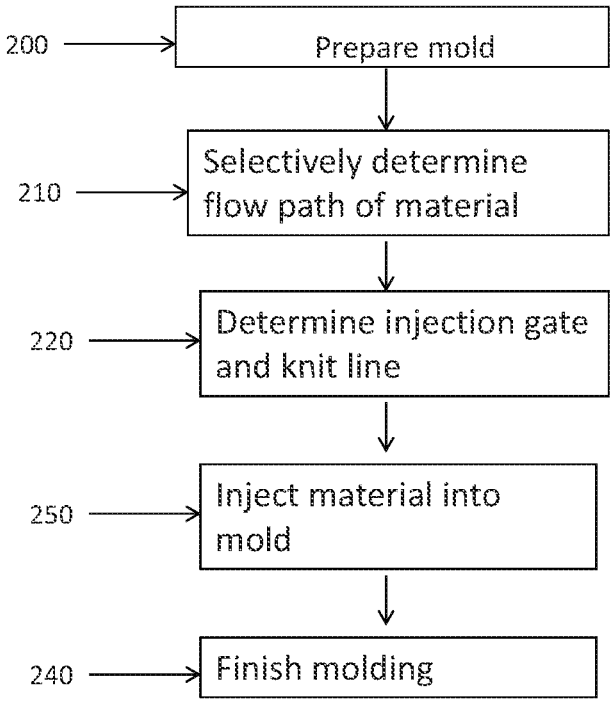
FIG. 10 is a flowchart illustrating a method of forming the valve lifter guide of FIG. 1.

Referring to FIG. 10, a method of forming the valve lifter guide is provided. In this example the valve lifter guide is molded using an injection molding process, although other molding processes are contemplated The method begins at block 200 with the step of preparing a mold to have a cavity with a configuration that defines the shape and structure of the valve lifter guide 10. The technique for preparing the mold is conventionally known. The mold cavity may have an integrally formed structure that directs the material flow in a manner to be described. For example, the structure may be a wall in the mold cavity the forms a channel in the formed component.

The methodology advances to block 210 with the step of selectively determining a flow path of material to be injected in the mold cavity by positioning a thin walled section in the formed valve lifter guide. The material tends to follow a flow path 40 of least resistance as it travels throughout the mold cavity. The directional orientation of the flow path 40 may be varied by the use of a thin wall section integrally formed into the molded valve lifter guide as shown at 42. The incorporation of a thin walled section 42 in the formed valve lifter guide 10 creates a dam that redirects the material flow path 40. In this example, the thin walled section 42 is a longitudinally extending channel located in the rear wall 12 of the valve lifter guide 10. The valve lifter guide may include more than one thin walled section formed in the formed component part to direct the material flow.

The methodology advances to block 220 and includes the step of determining a location for an injection gate to obtain a predetermined knit line 38 in the finished part. Various factors may be considered in the placement of both the gate and the knit line 38. In this example, as shown at 36, the gate is located at an upper end of the valve lifter guide 10, i.e. in the tab 26, in order to direct the flow of material throughout the mold cavity to achieve a knit line in a predetermined location in the finished valve lifter guide. The predetermined location of the knit line 38 may be selectively determined in an area of least stress of the formed component. By strategically positioning the knit line 38 within the area of least stress, the overall strength and durability of the valve lifter guide may be enhanced. In this example, the area of least stress is in the rear wall 12. The mold may contain a wall (not shown) to assist in defining the material flow and locating the knit line, i.e. by controlling the hoop stress.

Figure 4:
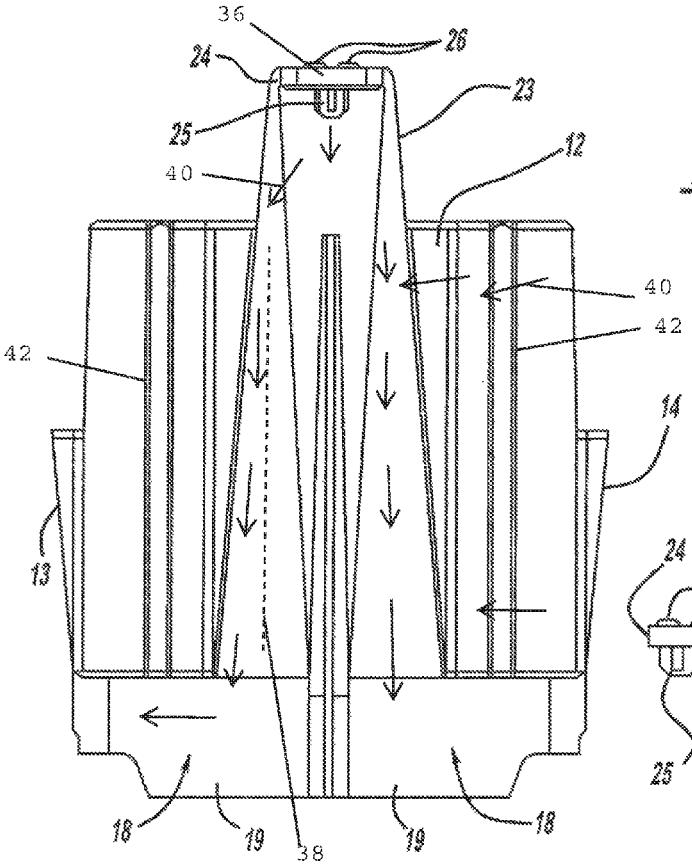
FIG. 4 is a rear view of the valve lifter guide of FIG. 1.
Figure 5:
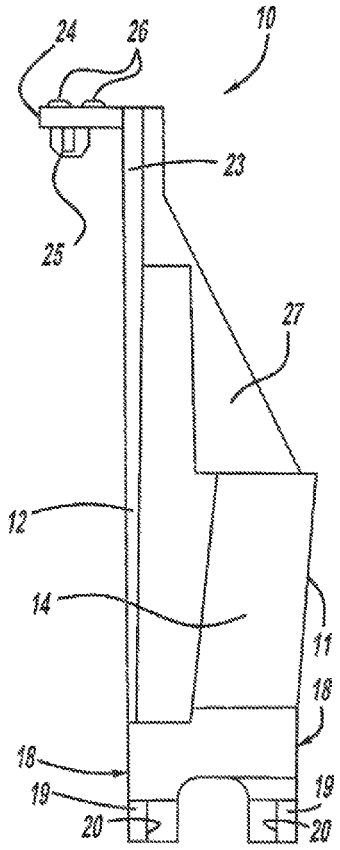
FIG. 5 is a side view of the valve lifter guide of FIG. 1.

The methodology advances to block 230 and includes the step of injecting the material into the mold cavity through the gate 36. The material in this example is a synthetic plastic polyamide, such as Nylon 66 or the like as previously described. The material is injected at a predetermined temperature. The path 40 of the leading edge of the material flow is illustrated by the arrows in FIG. 4. As described, the thin walled sections 42 of the rear wall influence the flow path of material by creating a dam, causing a portion of the leading edge of the material to flow down the face of the rear wall. At the same time, a portion of the leading edge of material may flow around the rear wall, a portion of the leading edge may flow to the front of the valve guide member and still another portion of the leading edge of material may flow back around to the rear wall. The leading flow edge and a trailing flow edge meet to form the knit line 38 in the valve lifter guide. Advantageously, the material flow path and resultant knit line 38 is selectively determined by creating thin wall sections in the formed valve lifter guide 10.

The methodology advances to block 340 and includes the step of finishing the valve lifter guide. For example, the material is cured in the mold, the mold is cooled and the finished valve lifter guide is removed from the mold. The resultant valve lifter guide is molded in an efficient manner and has improved strength characteristics.

Many modifications and variations of the present disclosure are possible in light of the above teachings. Therefore, within the scope of the appended claim, the present disclosure may be practiced other than as specifically described.

What is claimed is:

1. A method of molding a valve lifter guide of an engine block of an internal combustion engine, the method comprising:

preparing a mold having a mold cavity configured to form a valve lifter guide;

determining a flow path of material to be injected in the mold cavity by including a thin walled section in the formed valve lifter guide;

selecting a gate position in the mold cavity for a gate to inject material into the mold cavity according to the determined flow path of material; and injecting material into the mold cavity through the gate, such that a leading edge of the material flow path forms a dam when the leading edge of the material flow path crosses a thin walled section of the mold cavity, and the dam changes a direction of a portion of the leading edge of the material flow path until the leading edge of material flow meets a trailing edge of the material flow path within the mold cavity.

2. The method of claim 1, further comprising:

curing the material in the mold to form a valve lifter guide having a front wall, an opposed rear wall, end walls therebetween the front wall and rear wall and a bottom surface positioned at a lower edge of the front wall, rear wall and end walls, arranged to form an elongated valve lifter socket defining a longitudinal axis, the elongated socket dimensioned to receive a valve lifter therein, and a valve guide support member extending upwardly from the rear wall and a tab projecting away from the valve guide support member along an axis which is non-parallel to the longitudinal axis of the elongated valve lifter socket, the tab including a first projection extending away from the tab and dimensioned to be received in an opening provided in the engine block of the internal combustion engine.

3. The method of claim 2, wherein the thin walled section is formed in the rear wall of the valve lifter guide.

4. The method of claim 2, wherein the thin walled section is formed in an area of least stress of the valve lifter guide.

5. The method of claim 1, further comprising selectively determining a knit line in the formed valve lifter guide.

6. The method of claim 1, wherein injecting the material further comprises a portion of the leading edge of material traveling down and across the mold cavity to form a rear wall of the valve lifter guide, and around to form a front wall of the valve lifter guide.

7. The method of claim 1, wherein injecting the material comprises including a plurality of thin walled sections in the formed valve guide to control the flow path of material within the mold cavity.

* * * * *